United States Patent [19]

White

[11] B 3,993,232

[45] Nov. 23, 1976

[54] SHUTTLE MECHANISM

[75] Inventor: Neil S. White, Rochester, N.Y.

[73] Assignee: Eastman Kodak Company, Rochester, N.Y.

[22] Filed: Sept. 17, 1974

[21] Appl. No.: 506,926

[44] Published under the second Trial Voluntary Protest Program on February 17, 1976 as document No. B 506,926.

[52] U.S. Cl. ..... 226/68; 226/70

[51] Int. Cl.[2] ..... B65H 17/40

[58] Field of Search ..... 226/62, 64, 65, 66, 226/67, 68, 70–73, 147, 151

[56] References Cited

UNITED STATES PATENTS

| | | | |
|---|---|---|---|
| 2,268,405 | 12/1941 | Kohnle | 226/68 |
| 2,301,054 | 11/1942 | Laing | 226/62 |
| 2,996,001 | 8/1961 | Schlegel | 226/147 X |
| 3,051,361 | 8/1962 | Menkel | 226/151 X |
| 3,434,640 | 3/1969 | Coutant | 226/62 X |
| 3,477,627 | 11/1969 | Webers | 226/62 X |
| 3,587,960 | 6/1971 | Gerb | 226/62 |

*Primary Examiner*—Richard A. Schacher
*Attorney, Agent, or Firm*—S. W. Gremban

[57] ABSTRACT

A shuttle mechanism movable between initial and final positions for accurately, intermittently advancing a stretchable web containing spaced apart, encapsulated articles such as dental packets under a punch for cutting individual articles from the web. Front and rear claw tips enter succeeding sealed joints or grooves in the web in the initial position of the shuttle mechanism. While in this position, the rear claw is moved toward the front claw so that the pitch of the grooves is equal to the normal groove pitch of the web in its unstretched condition.

7 Claims, 3 Drawing Figures

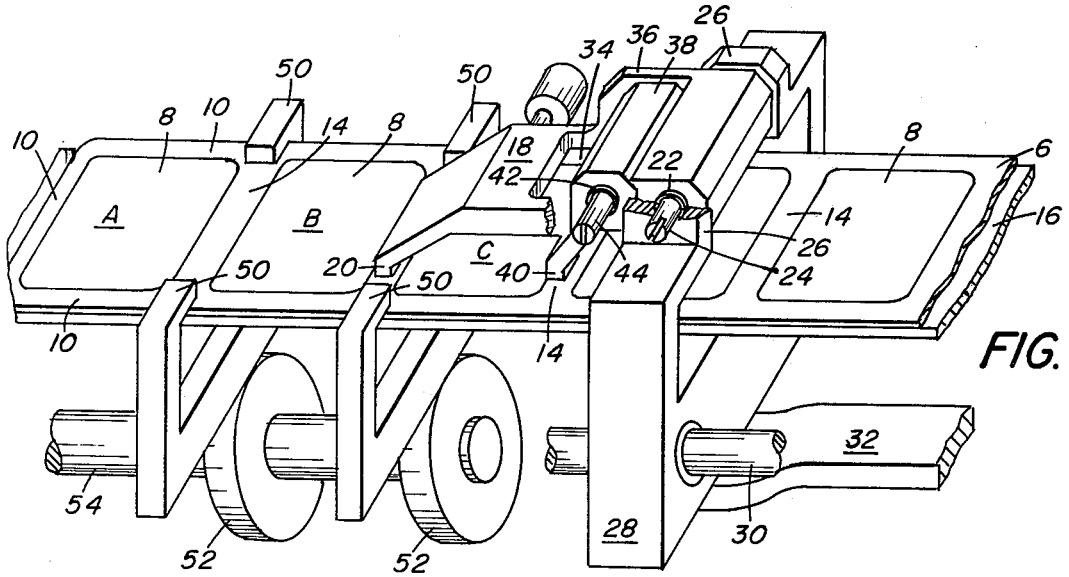
FIG. 1
FIG. 2
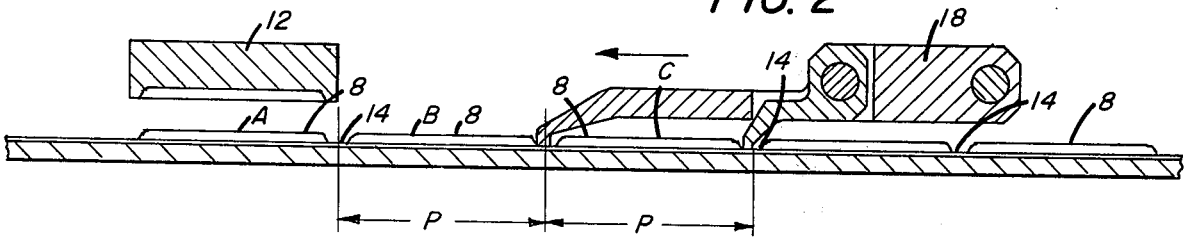
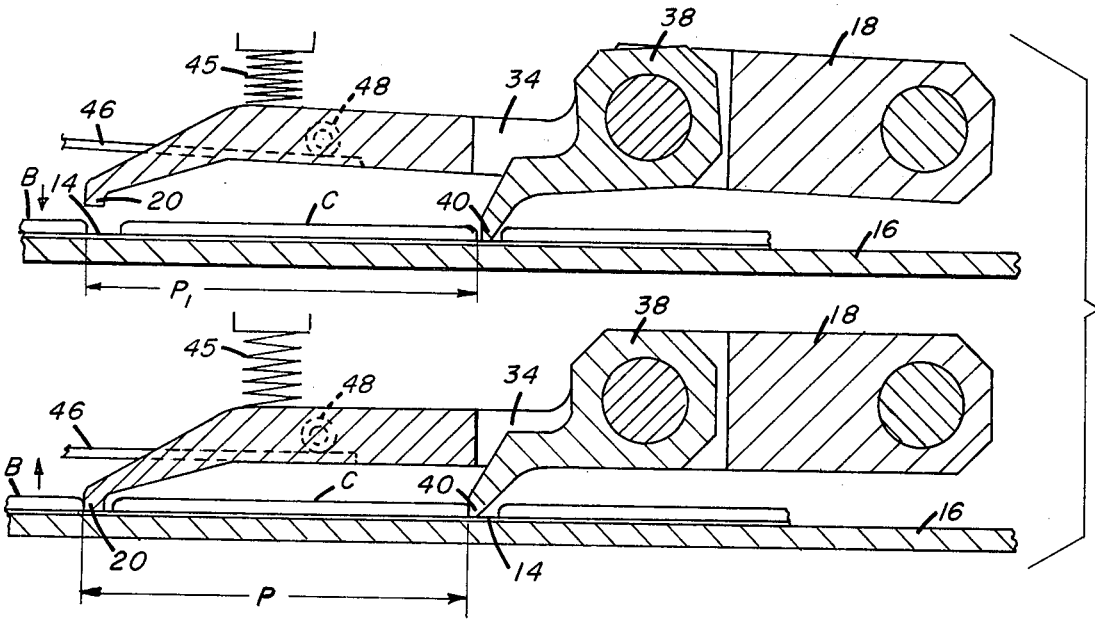
FIG. 3

SHUTTLE MECHANISM

BACKGROUND OF THE INVENTION

1. Field of the Invention

This invention relates generally to web transporting apparatus, and more specifically to a shuttle mechanism for accurately, intermittently advancing a stretchable web containing spaced apart, encapsulated articles.

2. Description of the Prior Art

Shuttle mechanisms for intermittently advancing a web a normal distance or pitch are generally well known in the art. For example, motion picture projectors, motion picture cameras and photographic printers all utilize a shuttle claw mechanism in which a claw enters a film perforation, is advanced a film pitch equal to the pitch between succeeding perforations in the film for advancing the film a film frame, is retracted from the film and returned to its initial position in which the claw enters the succeeding film perforation. However, in such applications, the film is relatively inelastic and unstretchable. Consequently, the film is advanced a correct or normal web pitch for each cycle of operation of the shuttle claw mechanism. A problem is presented, however, in those applications in which a web is intermittently advanced which is partially elastic or stretchable, such as occurs in the manufacture of dental X-ray packets. In such an application, several webs of various types of materials are combined to make a completed web containing spaced apart, encapsulated dental packets completely surrounded by sealed areas. The shuttle mechanism must intermittently advance the web, and for each advance must accurately align the dental packet with a rectangularly formed punch so that a uniform sealed area is present around the entire periphery of the packet when it is punched out of the web. Since the web is formed from a stretchable material such as polyvinyl chloride and is advanced against a variable web supply tension, it is impossible, due to the web stretching that occurs, for the shuttle mechanism to intermittently, accurately advance the dental web a normal pitch. Consequently, misalignment of the dental packet with the punch results causing the punch to cut through or seriously weaken one or more of the sealed edges of the dental packet.

SUMMARY OF THE INVENTION

In accordance with a preferred embodiment of the invention, a shuttle mechanism is disclosed for intermittently transporting over a web support bed a stretchable web of the type having spaced, claw engaging portions such as joints or grooves of a normal pitch when the web is in its normal unstretched condition. The shuttle mechanism comprises a first member reciprocally movable between initial and final positions and having a front claw for engaging a groove in the web. A second member is mounted on the first member for movement relative thereto, and has a rear claw for engaging a succeeding groove in the web. When the first member is in its initial position, the claws are seated in a pair of grooves and the rear claw moved by the bed to a retracted position, in which the distance between the tips of the front and rear claws is equal to the normal pitch. When the first member is in its final position, the front claw is withdrawn from its groove and the rear claw stays in its groove but is moved to an extended position in which the distance between the tips of the front and rear claws is greater than the normal pitch of the web. Accordingly, when the first member is moved from its initial to its final position, the web portion, such as a dental packet between the claws is accurately advanced to a cutting position at the punch station. The punch, when actuated, punches the web portion out of the web with a uniform sealed area around the periphery of the web portion.

More specifically, in this embodiment of the invention, first moving means are provided for reciprocally moving the first member between its initial and final positions. Second moving means are provided for moving the first member relative to the web when the first member is in its final position for withdrawing the first claw from a groove in the web, and allowing the rear claw to move to its extended position. A web support is provided over which the web is transported, and clamping means are provided for clamping the web to the web support during return movement of the first member from its final position to its initial position. Cam means are also provided coupled to the moving means and clamping means for operating the two in timed relation.

It is accordingly one of the objects and advantages of the present invention to provide a shuttle mechanism that is capable of intermittent, high speed transport of a stretchable web for bringing successive web portions or articles to a work station in proper register therewith.

Another object and advantage of the invention is to provide a shuttle mechanism that compensates for the web stretch in a stretchable web so that successive web portions are transported to a work station in proper register therewith.

Another object and advantage of the invention is to provide a shuttle mechanism in which the pitch of the grooves of a stretchable web portion transported to a work station is maintained at the normal groove pitch of the web in its unstretched condition.

Another object and advantage of the invention is to provide a shuttle mechanism that is of simple design and construction, thoroughly reliable and efficient in operation, and economical to manufacture.

The invention and its objects and advantages will become more apparent from the detailed description of the preferred embodiments presented below.

BRIEF DESCRIPTION OF THE DRAWING

In the detailed description of the preferred embodiments of the invention presented below, reference is made to the accompanying drawing, in which:

FIG. 1 is a segmental view in perspective of a preferred embodiment of a shuttle mechanism of this invention;

FIG. 2 is a side elevational view in section of the shuttle head of the mechanism of FIG. 1; and FIGS. 3A and B are side elevational views in section of the shuttle head, illustrating in FIG. 3A the position of a head when it returns to its initial position, and in FIG. 3B the position of the head when it is seated in its initial position.

DESCRIPTION OF THE PREFERRED EMBODIMENTS

Since shuttle mechanisms are generally well known, the present description will be directed to elements forming part of or cooperating more directly with apparatus in accordance with the present invention. Elements of shuttle mechanisms not specifically shown or described should be understood to be selectable from those known in the art.

With reference to the drawings, a preferred embodiment of a shuttle mechanism is disclosed for intermittently advancing a stretchable web 6 of dental X-ray packets 8 to a punching station where individual packets are punched from the web. In a finished web 6 of this type, several webs of various kinds of raw materials are joined together in various operations. The end result is a stretchable web 6 containing spaced apart, encapsulated dental X-ray packets 8 in which the portions 10 of the web surrounding the packets are sealed together. The shuttle mechanism of this invention intermittently advances web 6 and accurately aligns each dental packet 8 with a punch 12 so that each packet is punched out of the web with a uniform sealed area around the periphery of the packet. The uniform sealed area 10 is necessary in order to provide dental X-ray packets having well-sealed edges to prevent light leakage into the packet, and to also provide a pleasing aesthetic appearance. Although the shuttle mechanism of this invention has been found to be particularly useful in the intermittent transport of a stretchable web 6 containing dental X-ray packets, it should be understood that this mechanism could be useful in the transport of any type of stretchable web.

In the intermittent transport of a stretchable web 6, the web is provided with a plurality of spaced apart web portions 14 such as perforations, grooves, or the like which are engageable by the shuttle mechanism. The web portions or grooves 14 have a normal pitch P when the web is in its normal unstretched condition. However, this groove pitch P of the web can vary as a result of stretching forces on the web, temperature, roll-to-roll variations in raw materials, etc. The function of the shuttle mechanism of this invention is to maintain the normal pitch P even though the actual pitch $P_1$ (FIG. 3) may exceed the normal pitch P due to these external forces. As a result, the shuttle mechanism precisely locates each packet 8 relative to punch 12 so that it is punched out of the web with a uniform sealed area around the periphery of the packet.

With reference to FIG. 1, a preferred embodiment of the shuttle mechanism of this invention comprises a stationary web support bed 16 over which the stretchable web 6 is intermittently transported. The web contains a plurality of spaced apart, dental packets 8 entirely surrounded by sealed areas 10, and the sealed joints or grooves 14 between the packets are of normal pitch P when the web is in its normal unstretched condition. The shuttle mechanism comprises a first member 18 having a first claw 20 at one end for engaging successive grooves 14 in the web. The opposite end of member 18 is pivotally mountable on an eccentric portion 22 of a shaft 24, the ends of which are rotatably journaled in side plates 26 of a bracket 28. The bracket is slidably mounted on guide rods 30, only one of which is shown, and is reciprocally movable between initial and final positions by any suitable mechanism such as a crank, not shown, connected to bracket 28 by a connecting rod 32. The front claw 20 is adjustably movable in the longitudinal direction of web 6 by rotatably adjusting the position of shaft 24 and hence the eccentric portion 22. The shaft 24 has a slot at one end and is rotatably adjustable by any suitable means such as a screw driver. Any suitable means such as a lock nut, not shown, threadable on shaft 24 can be provided for releasably locking the shaft in an adjusted position.

The first member 18 is further provided with an opening 34 extending therethrough to form a pair of side flanges 36, one of which is broken away in FIG. 1. A second member 38 has a rear claw 40 at one end and the opposite end pivotally mounted on an eccentric portion 42 of a shaft 44, the ends of which are journaled within side flanges 36 of member 18. One of the shaft ends extends through flange 36 and is provided with means such as a slot engageable by a screw driver for adjustably rotating shaft 44 and eccentric portion 42, and hence adjustably moving rear claw 40 in the longitudinal direction of the web. Once adjusted, shaft 44 can be locked in position by any suitable means such as lock nuts or the like.

In the initial position of the shuttle mechanism, the front and rear claws 20, 40 respectively are in engagement with succeeding grooves 14 of web 6. In this initial position, the first member 18 is urged or biased by a spring 45 (FIG. 3) against a support bed 16 causing the front and rear claws 20, 40 respectively to enter succeeding grooves 14 in the web. The front and rear claws have been previously adjusted so that the distance between the front tips of the claws is equal to the normal pitch P of the web grooves 14. The claws remain in this position during forward movement of the shuttle mechanism from its initial position to its final position. During such movement, the web 6 is transported one stroke equal to the normal web joint pitch P, and this transports packet 8 to the punch station in register with punch 12 as illustrated in FIG. 2. In the final position of the shuttle mechanism, a plate 46 (FIG. 3) is moved upwardly by any suitable cam mechanism or the like causing the plate to engage roller 48 mounted on a stub shaft journaled in member 18, and to pivot the member upwardly generally into position similar to the position illustrated in FIG. 3A. In this position, front claw 20 is retracted out of its groove 14 and rear claw 40 pivots slightly under the influence of gravity in a counterclockwise direction to its extended position while still remaining in its groove. Also, clamps 50 are actuated by cams 52 on a cam shaft 54 for clamping web 6 to web bed 16. The shuttle mechanism is then returned to its initial position during which movement the front claw 20 remains retracted and rear claw 40 gently slides over packet C. When the shuttle mechanism reaches its initial position as illustrated in FIG. 3A, plate 46 is moved downwardly causing front claw 20 to enter groove 14 with the leading tip thereof in engagement with the edge of packet B. During downward pivotal movement of member 18, rear claw 40 is pivoted in a clockwise direction to its retracted position causing the leading edge thereof to engage one end of packet C and to move the packet toward the front claw causing the stretched groove 14, between packets B and C (FIG. 3A) to shorten to its normal size as seen in FIG. 3B. Accordingly, the web groove pitch of packet C is equal to the normal groove pitch P of the web in its normal unstretched condition. The clamps 50 are actuated to release web 6, and the shuttle mechanism is ready for another cycle of operation. The operation of web clamps 50, plate 46 and pivotal movement of member 18 occur in timed relation by virtue of cam means and control circuitry of any suitable type.

The invention has been described in detail with particular reference to preferred embodiments, but it will be understood that modifications and variations can be effected within the spirit and scope of the invention as described.

I claim:

1. In a shuttle mechanism for use in intermittently transporting a stretchable web having spaced first, second, and third succeeding grooves of a normal pitch in its normal unstretched condition; the combination comprising:

a first member reciprocally movable between initial and final positions for intermittently transporting a web, said first member having a first claw at one end thereof provided with a leading tip surface for engaging a first groove in said web;

a second member supported by said first member for movement between extended and retracted positions, and having a second claw provided with a leading tip surface for engaging a succeeding second groove in said web and assisting in the transport of said web by said first member;

first means for moving said first member between said initial and final positions; and second means for moving said first member when said first member is positioned in its final position causing said first claw to be removed from said first groove while allowing said second claw to move while in said second groove away from said first claw to its extended position in which the distance between said leading tip surfaces of said first and second claws is greater than said normal pitch of said grooves, and for moving said first member when said first member is returned to its initial position causing said first claw to move into said second groove and said second claw into a succeeding third groove, and further moving while in its third groove to its retracted position, in which the distance between said leading tip surfaces of said first and second claws and the distance between said second and third grooves are both equal to said normal pitch whereby said claws are in position to transport said web a distance equal to said normal pitch upon movement of said first member to its final position.

2. The invention according to claim 1 wherein said first member is pivotally secured to said first moving means, and said second moving means engages and pivots said first member relative to the web.

3. The invention according to claim 1, and further comprising a web support over which the web is moved, and clamping means for clamping the web to said web support during return movement of said first member from its final position to its initial position.

4. The invention according to claim 3, and further comprising cam means coupled to said second moving means and said clamping means for operating said second means and said clamping means in timed relation.

5. In a web transporting mechanism for intermittently transporting over a web support bed a stretchable web of the type having uniformly spaced articles connected by joints, the combination comprising:

a reciprocally movable shuttle mechanism movable a forward stroke from an initial position to a final position for transporting said web a normal web pitch, and then a backward stroke for returning to its initial position without transporting said web;

said shuttle mechanism having forward and rearward relatively movable claws, both of which are in engagement with succeeding ones of said joints during said forward stroke and one of which is disengaged from one of said joints during said backward stroke, said rearward claw in said initial position of said shuttle mechanism being movable relative to said forward claw by said support bed to a retracted position in which the pitch between the tips of said claws is equal to said normal web pitch, and in said final position of said shuttle mechanism being movable to an extended position in which the pitch between the tips of said claws is greater than said normal web pitch.

6. In a web transporting mechanism for intermittently transporting over a web support bed a stretchable web of the type having uniformly spaced articles connected by joints, the combination comprising:

a shuttle mechanism having forward and rearward web engaging claws movable relative to one another between a retracted position in which the claw tip pitch is equal to a normal web pitch, and an extended position in which the claw tip pitch is greater than said normal web pitch;

control means cooperating with said web support bed for moving said forward and rearward claws between said retracted and extended positions; and means for moving shuttle mechanism from an initial position to a final position during which said control means and said support bed cooperate to move and hold said claws in their retracted position and in engagement with succeeding joints for transporting said web said normal web pitch, and then for returning said shuttle mechanism from said final position to said initial position during which said control means allows said claws to move to their extended position, said control means and said support bed again cooperating to return said claws to their retracted position at said initial position of said shuttle mechanism causing said forward and rearward claws to engage succeeding joints in the web, and said rearward claw to engage and move an article between said joints toward said forward claw so that the web pitch between said joints is equal to said normal web pitch.

7. In a shuttle mechanism for use in intermittently transporting a stretchable web having spaced grooves of a normal pitch in its normal unstretched condition, the combination comprising:

a first member having a first claw at one end provided with a tip surface for engaging a first groove in the web;

a second member movably mounted on said first member and having a second claw at one end provided with a tip surface for engaging a succeeding second groove in the web;

first means for causing said second member to move between an extended position in which one of said first and second claws is disengaged from the web and the distance between said tip surfaces of said first and second claws is greater than the normal pitch of the web, and a retracted position in which said first and second claws are in engagement with said first and second grooves in the web and the distance between said tip surfaces of said first and second claws is equal to said normal pitch; and second means for moving said first member from an initial position to a final position while said second member is in its retracted position for transporting the web a distance equal to said normal pitch, and for returning said first member to said initial position while said second member is in its extended position.

* * * * *